US006889876B2

(12) United States Patent
Markert

(10) Patent No.: US 6,889,876 B2
(45) Date of Patent: May 10, 2005

(54) CENTER DISPENSER CAP ASSEMBLY

(75) Inventor: Brooks R. Markert, Harwinton, CT (US)

(73) Assignee: C&N Packaging, Inc., Wyandanch, NY (US)

( * ) Notice: Subject to any disclaimer, the term of this patent is extended or adjusted under 35 U.S.C. 154(b) by 33 days.

(21) Appl. No.: 10/458,113

(22) Filed: Jun. 10, 2003

(65) Prior Publication Data

US 2004/0004095 A1 Jan. 8, 2004

Related U.S. Application Data

(60) Provisional application No. 60/388,116, filed on Jun. 11, 2002.

(51) Int. Cl.[7] ..... B67D 5/32

(52) U.S. Cl. ..... 222/521; 222/549

(58) Field of Search ..... 222/519–523, 222/525, 544, 548, 549, 554

(56) References Cited

U.S. PATENT DOCUMENTS 5,004,127 A * 4/1991 Morel ..... 222/521
5,161,718 A * 11/1992 Gueret ..... 222/212
6,338,425 B1 * 1/2002 Berge et al. ..... 222/521

* cited by examiner

*Primary Examiner*—J. Casimer Jacyna
(74) *Attorney, Agent, or Firm*—Gerald T. Bodner

(57) ABSTRACT

A center dispenser cap assembly for mounting on a container includes a clear outer shell, a colored inner sleeve which is closely received by the clear outer shell, and a plug structure which is fitted into an opening in a neck of the container. The outer shell and inner sleeve cooperate with the plug structure to selectively allow the contents of the container to be dispensed centrally through the cap assembly when the cap is rotated a quarter turn on the container.

18 Claims, 19 Drawing Sheets

CENTER DISPENSER CAP ASSEMBLY

CROSS-REFERENCE TO RELATED APPLICATION

This application is based on U.S. Provisional Patent Application Ser. No. 60/388,116, filed on Jun. 11, 2002, and entitled "Center Dispenser Cap Assembly", the disclosure of which is incorporated herein by reference.

BACKGROUND OF THE INVENTION

1. Field of the Invention

This invention relates to dispenser caps for dispensing liquid or other fluid material, and more particularly relates to a dispenser cap assembly which is fitted onto a container and which selectively seals in the contents of the container.

2. Description of the Prior Art

Dispensing caps for containers used in the food, beverage, personal care and cosmetics industries are well known to be structured such that they may be removed from their respective containers by a user applying a quarter-turn rotational force. This allows the user to quickly dispense the contents of the container without the need and time required to untwist the cap with multiple, 360° rotations of the cap with respect to the container on which it is seated.

A problem with all dispenser caps, and more particularly with those which require only a quarter turn to be removed from their respective containers, is to ensure that the contents of the container are sealed by the cap prior to their being dispensed. Many dispenser caps have threads cooperatingly engaging corresponding threads on the mouth or neck of the container for releasably mounting the caps on the containers. Very often, such cooperating threads on the cap and container are relied upon to seal the contents of the container prior to their being dispensed. Because quarter-turn dispenser caps have limited engagement with the threads of the container, there is the possibility that they do not provide a sufficient seal, and inadvertent leakage of the contents of the containers on which the dispenser caps are mounted may occur.

In each of the aforementioned industries, and in particular the personal care and cosmetics industries, the appearance (e.g., shape and color) and other aesthetics of the cap and container are of utmost importance and contribute to the marketability of the product. The color of the cap and container is an important factor in this regard. In the highly competitive and crowded cosmetics and personal care fields, a consumer may be influenced to purchase one product over another based solely on the color of the container.

Also, manufacturers very often offer variations of their products, with such variations denoted by different product container colors. For example, a manufacturer's shampoo for oily hair may be denoted by a red container, while a shampoo for dry hair may be sold in a brown container, with all other aspects of the container, such as shape, style or function, remaining common for that product (e.g., shampoo).

Furthermore, many manufacturers prefer to have their products standing vertically, that is, either upright on a shelf by resting on the bottom of the container, or upside down by resting on the cap mounted on the container. Shelf space, not only in a retail store but also in a consumer's home, is limited, and very often vertically disposed containers take up less space. Containers which rest upside down on their caps must be sufficiently stable so that they do not inadvertently, and annoyingly, tip over. For containers disposed upside down, the cap must provide the necessary stability and support, and particularly must ensure that the product held in the container does not inadvertently leak out.

OBJECTS AND SUMMARY OF THE INVENTION

It is an object of the present invention to provide a dispenser cap for a container which ensures that the contents of the container will not inadvertently leak out.

It is another object of the present invention to provide a dispenser cap for a container that dispenses the contents of the container through the center of the cap.

It is still another object of the present invention to provide a center dispenser cap assembly for a container which is structured to allow the product to be dispensed from the center thereof and to permit the container on which it is mounted to rest vertically upside down on the cap.

It is yet a further object of the present invention to provide a dispenser cap assembly in which the perceivable color of the cap may be easily and cost effectively changed by the manufacturer.

It is still another object of the present invention to provide a dispenser cap which overcomes the inherent disadvantages of conventional dispenser caps.

In accordance with one form of the present invention, a dispenser cap assembly for mounting on a container having an opening formed therein includes an outer shell, an inner sleeve received by the outer shell and a plug structure received by the opening of the container and the inner sleeve and cooperating with the inner sleeve to selectively allow egress of the contents of the container through the inner sleeve and outer shell. Preferably, the outer shell is at least partially transparent so that the inner sleeve, which may be colored or have a design or writing on an exposed sidewall thereof, is viewable therethrough.

The plug structure preferably includes an outer sidewall, an inner closed plug disposed radially inwardly of the outer sidewall and at least one rib extending between the outer sidewall of the plug structure and the inner closed plug to support the plug in a spaced apart relationship to the outer sidewall. The outer sidewall of the plug structure and the inner closed plug thus define therebetween an open area to allow egress of the contents of the container to pass therethrough. The inner closed plug is selectively in contact with the edge of an opening formed in a top wall of the inner sleeve to selectively allow egress of the contents of the container to pass through the opening in the top wall of the inner sleeve.

These and other objects, features and advantages of the present invention will become apparent from the following detailed description of illustrative embodiments thereof, which is to be read in connection with the accompanying drawings.

DESCRIPTION OF THE PREFERRED EMBODIMENTS

Figure 1:
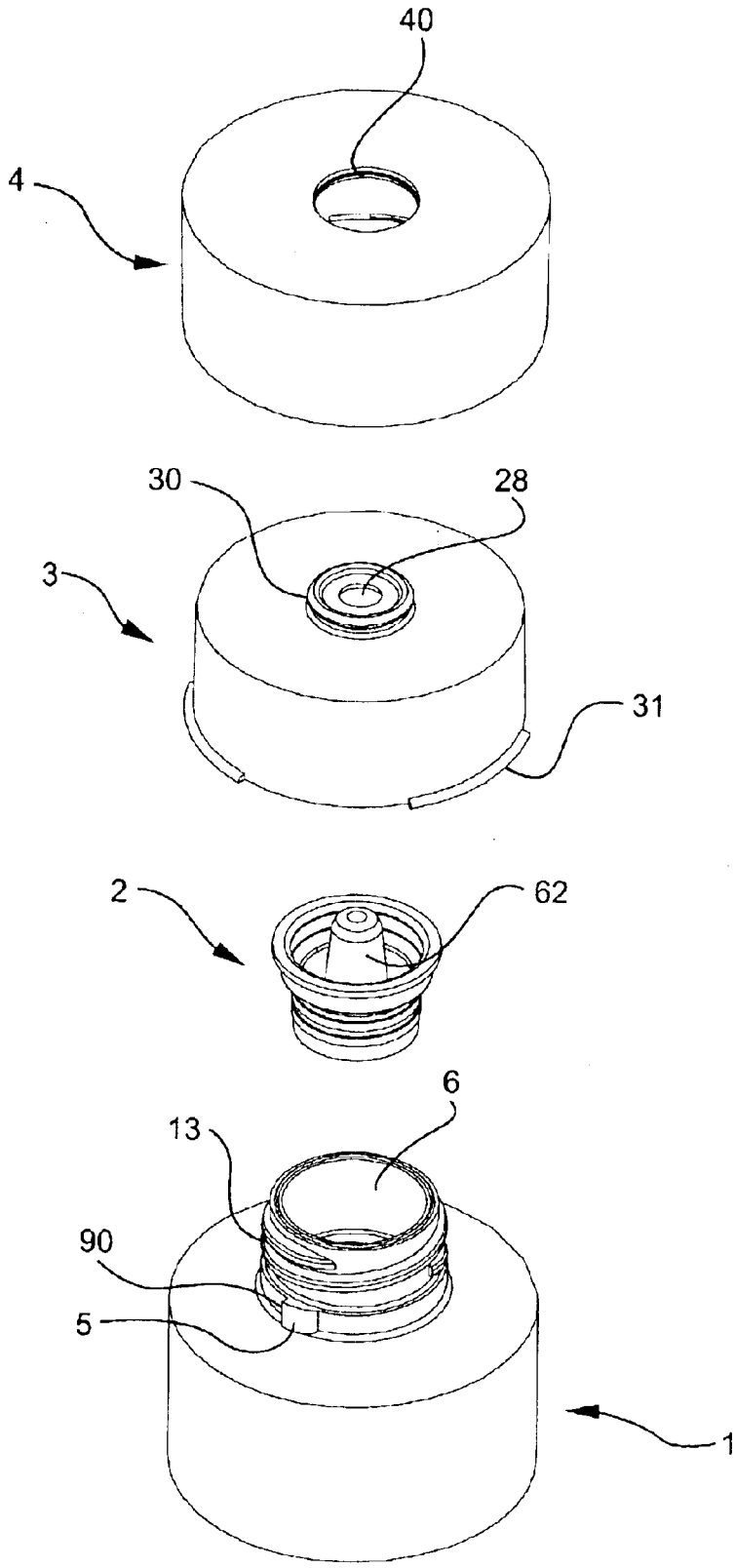
FIG. 1 is an exploded, top isometric view of the dispenser cap assembly of the present invention, and illustrating its relation to a container on which it is mounted.
Figure 2:
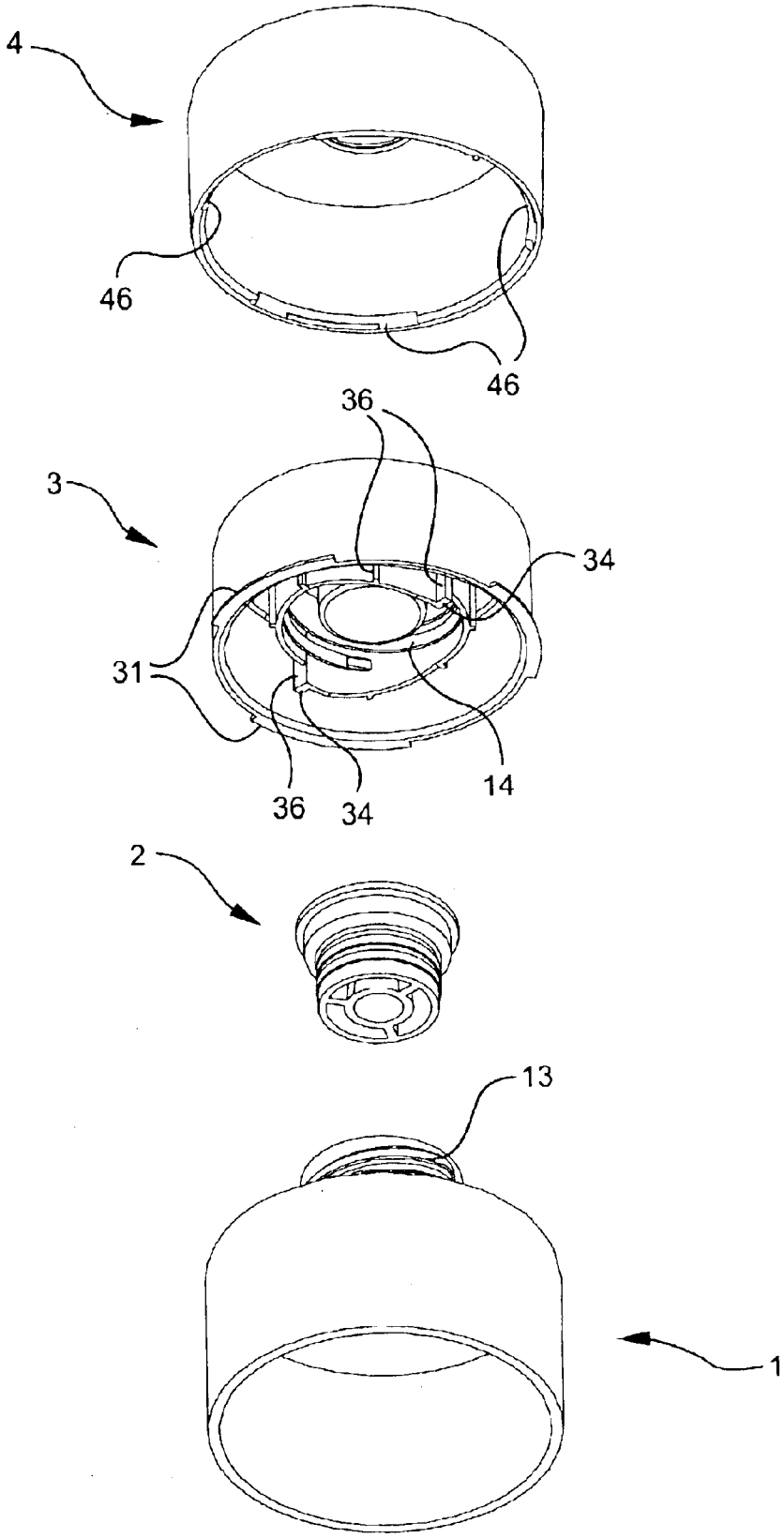
FIG. 2 is an exploded, bottom isometric view of the dispenser cap assembly of the present invention, showing its relation to a container on which it is mounted.
Figure 3:
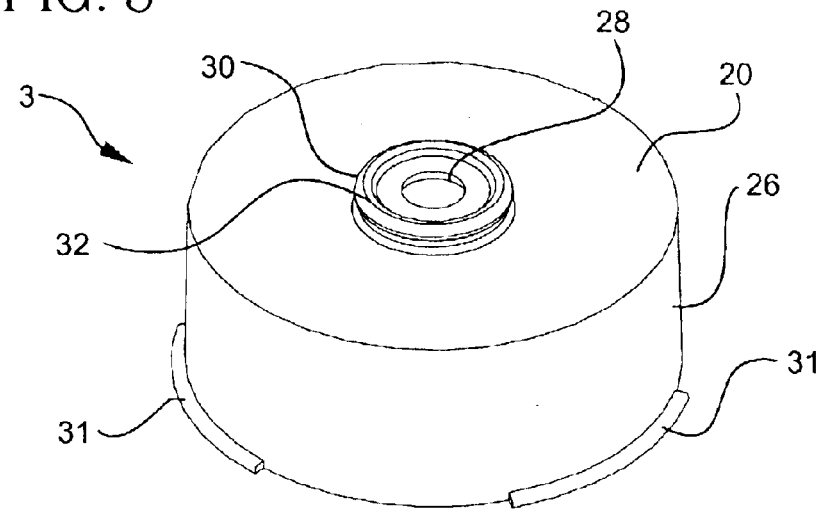
FIG. 3 is a top isometric view of the inner sleeve of the dispenser cap assembly of the present invention.
Figure 4:
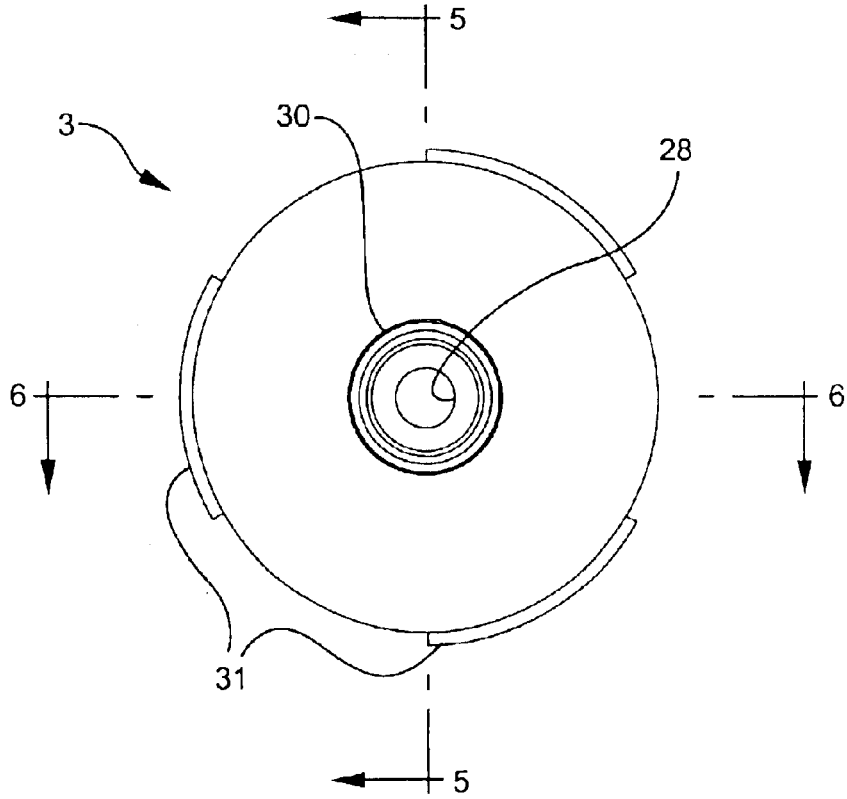
FIG. 4 is a top plan view of the inner sleeve of the dispenser cap assembly of the present invention.
Figure 5:
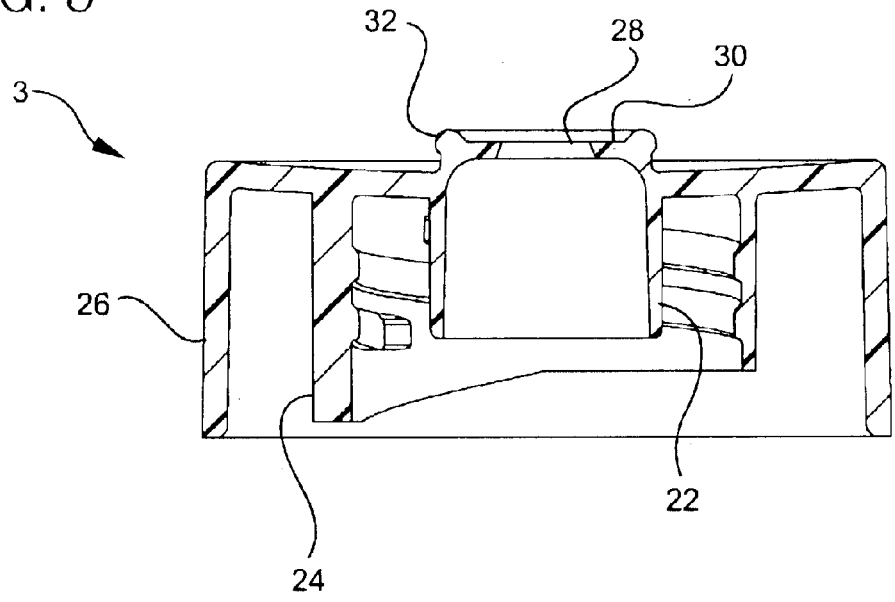
FIG. 5 is a cross sectional view of the inner sleeve of the dispenser cap assembly of the present invention, taken along line 5—5 of FIG. 4.
Figure 6:
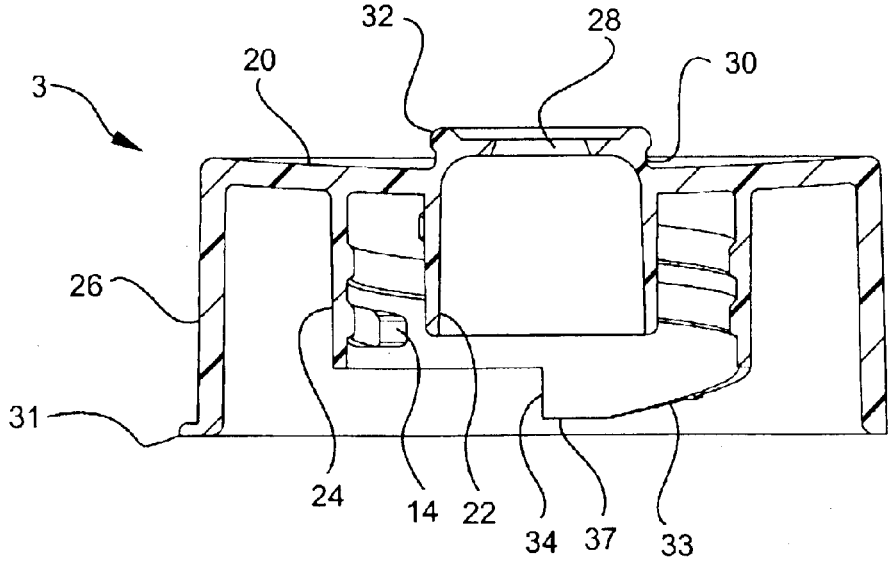
FIG. 6 is a cross sectional view of the inner sleeve of the dispenser cap assembly of the present invention, taken along line 6—6 of FIG. 4.
Figure 7:
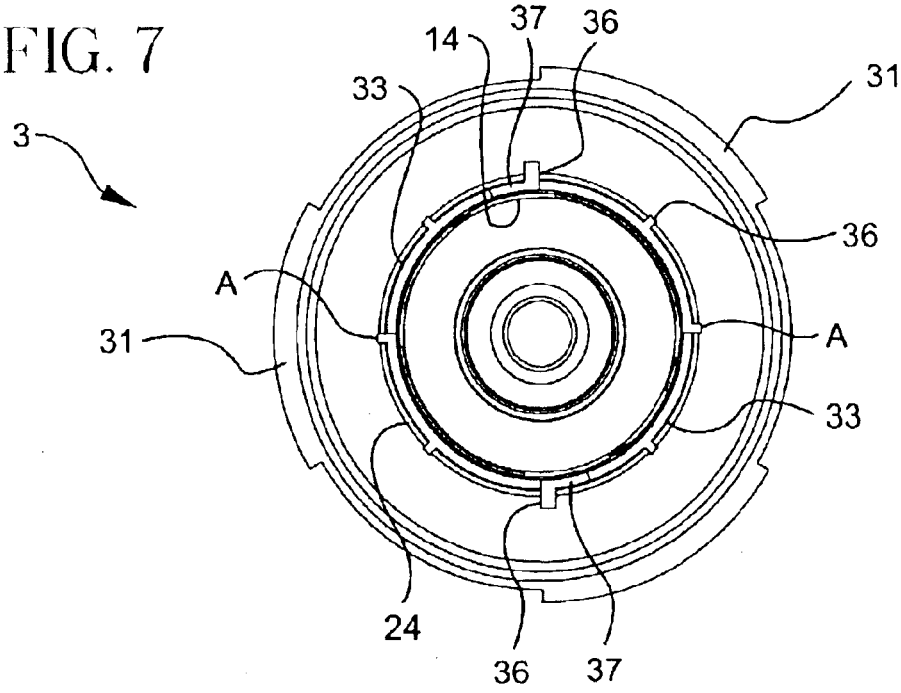
FIG. 7 is a bottom plan view of the inner sleeve of the dispenser cap assembly of the present invention.
Figure 8:
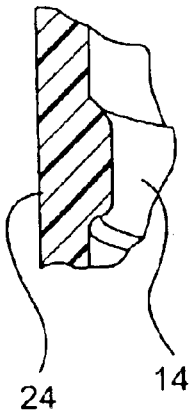
FIG. 8 is an enlarged, detailed view of a portion of the inner sleeve of the dispenser cap assembly of the present invention.
Figure 9:
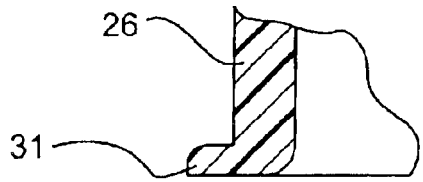
FIG. 9 is an enlarged, detailed view of a portion of the inner sleeve of the dispenser cap assembly of the present invention.
Figure 10:
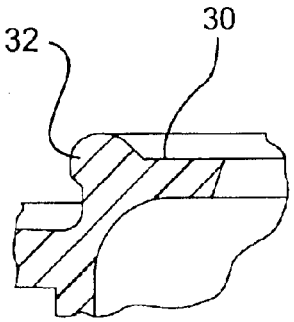
FIG. 10 is an enlarged, detailed view of a portion of the inner sleeve of the dispenser cap assembly of the present invention.
Figure 11:
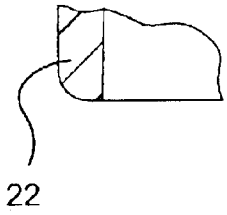
FIG. 11 is an enlarged, detailed view of a portion of the inner sleeve of the dispenser cap assembly of the present invention.
Figure 12:
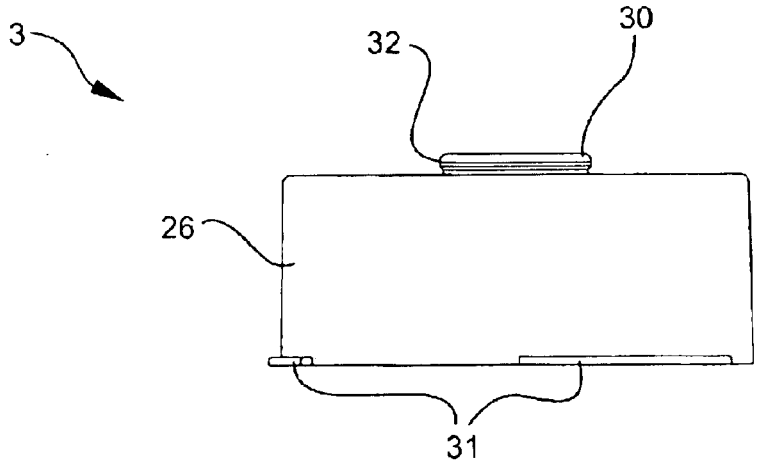
FIG. 12 is a side view of the inner sleeve of the dispenser cap assembly of the present invention.
Figure 13:
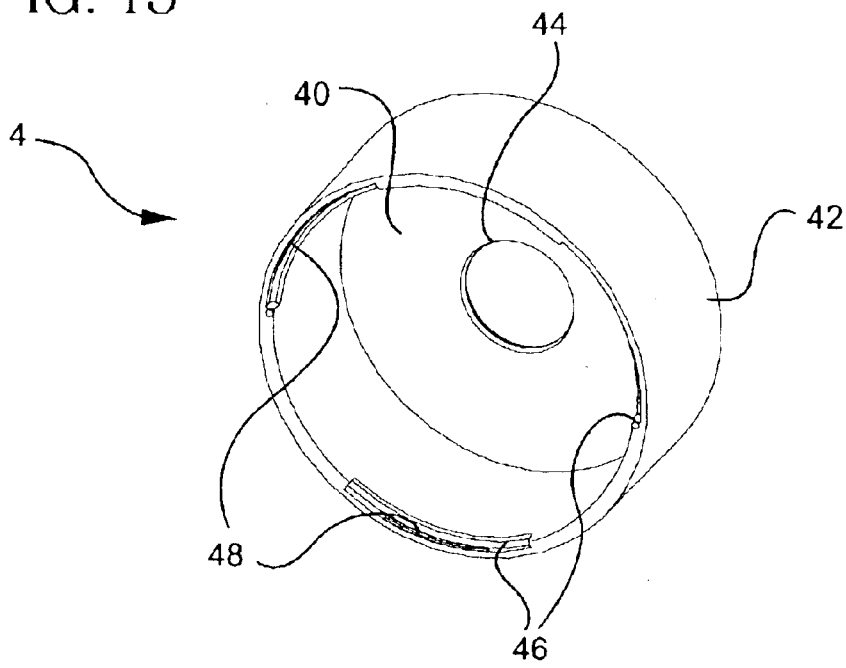
FIG. 13 is a bottom isometric view of the outer shell of the dispenser cap assembly formed in accordance with the present invention.
Figure 14:
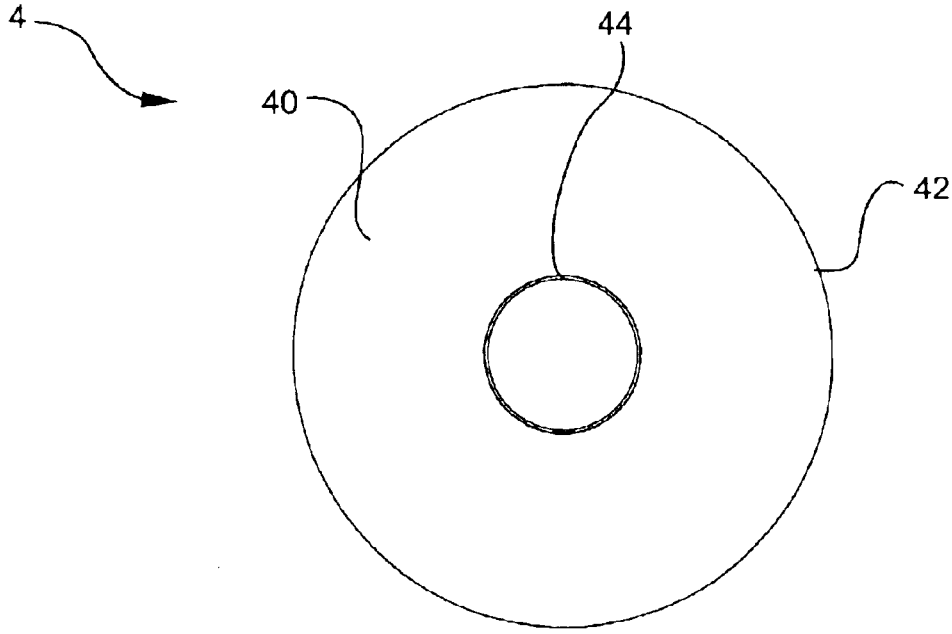
FIG. 14 is a top plan view of the outer shell of the dispenser cap assembly of the present invention.
Figure 15:
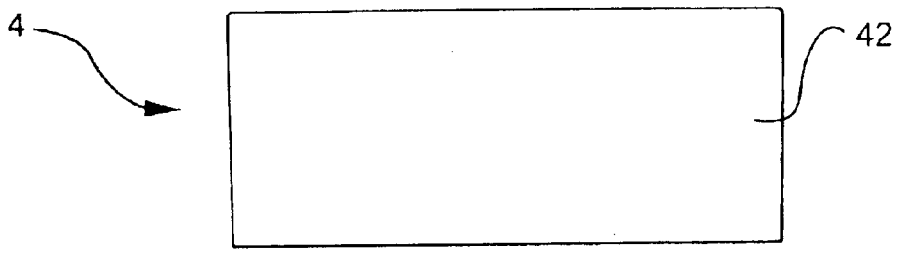
FIG. 15 is a side view of the outer shell of the dispenser cap assembly of the present invention.
Figure 16:
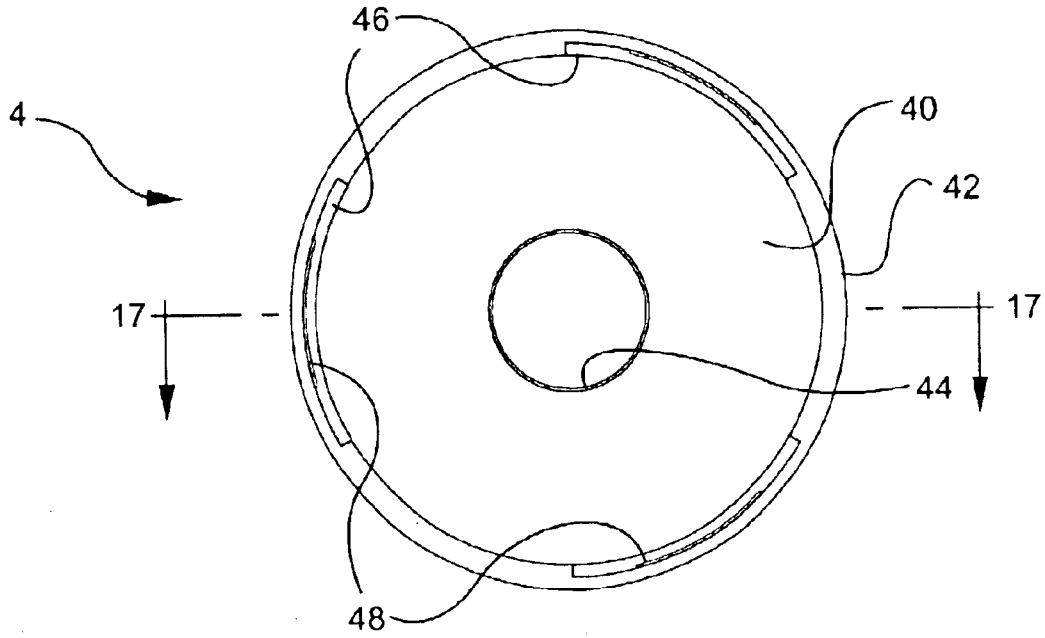
FIG. 16 is a bottom view of the outer shell of the dispenser cap assembly of the present invention.
Figure 17:
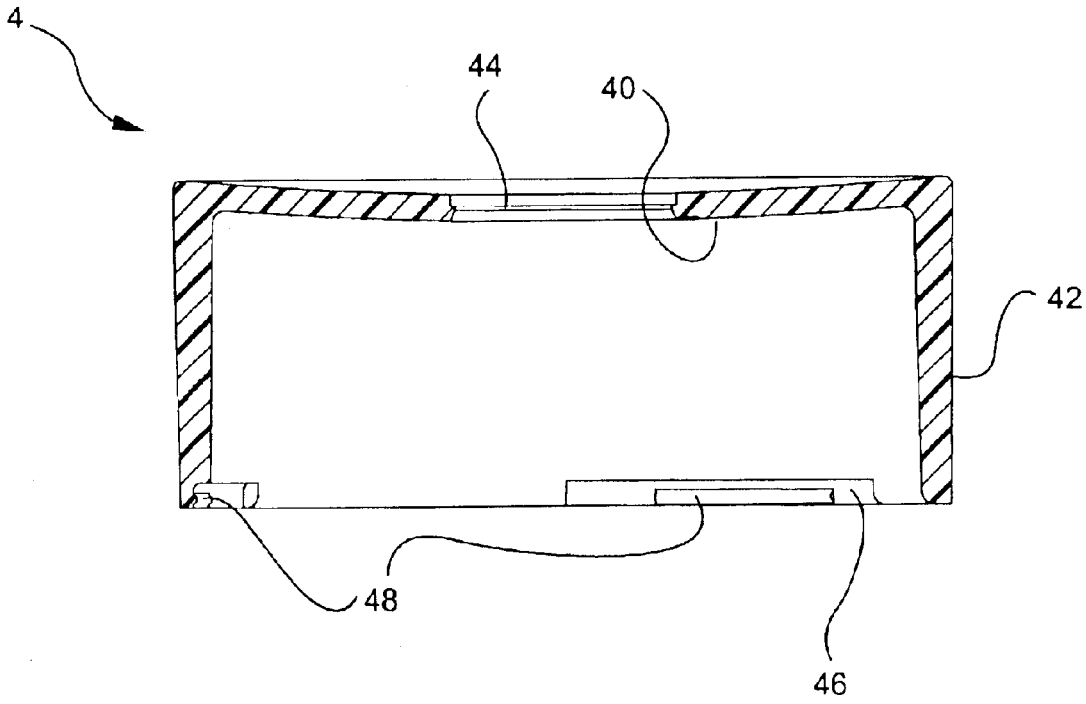
FIG. 17 is a cross sectional view of the outer shell of the dispenser cap assembly, taken along line 17—17 of FIG. 16.
Figure 18:
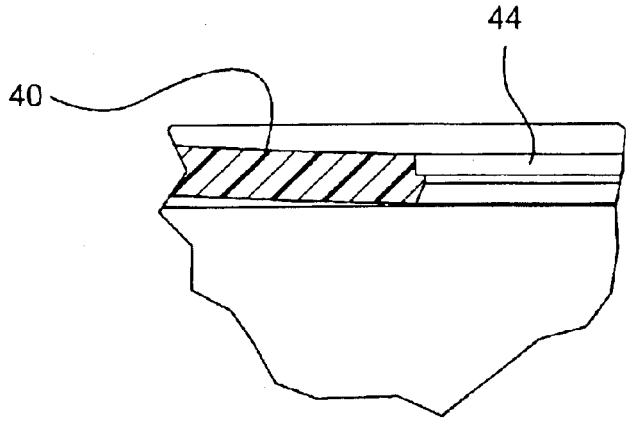
FIG. 18 is an enlarged, detailed view of a portion of the outer shell of the dispenser cap assembly of the present invention.
Figure 19:
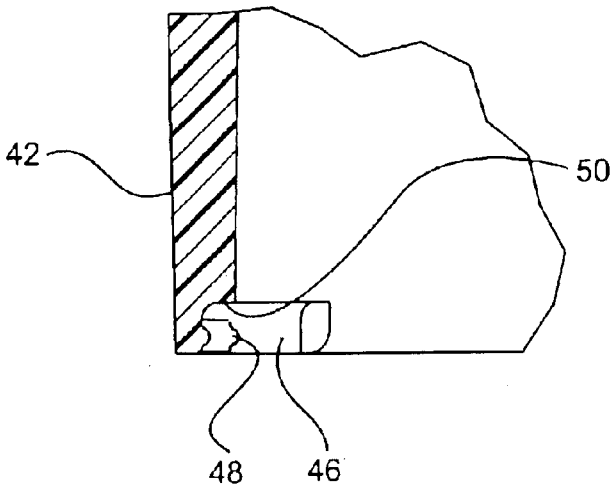
FIG. 19 is an enlarged, detailed portion of the outer shell of the dispenser cap assembly of the present invention.
Figure 20:
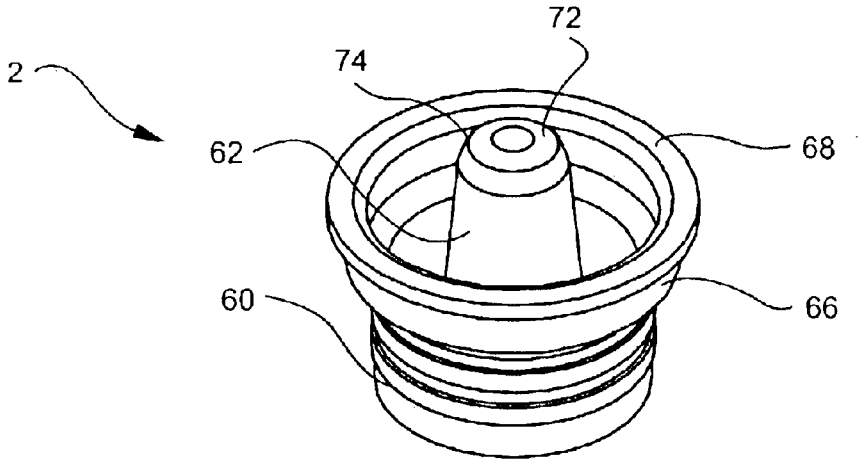
FIG. 20 is a top isometric view of the plug structure of the dispenser cap assembly formed in accordance with the present invention.
Figure 21:
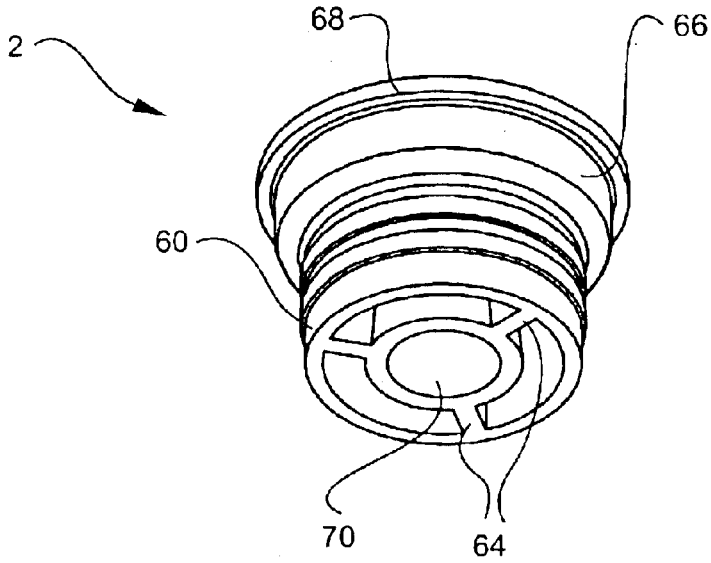
FIG. 21 is a bottom isometric view of the plug structure of the dispenser cap assembly formed in accordance with the present invention.
Figure 22:
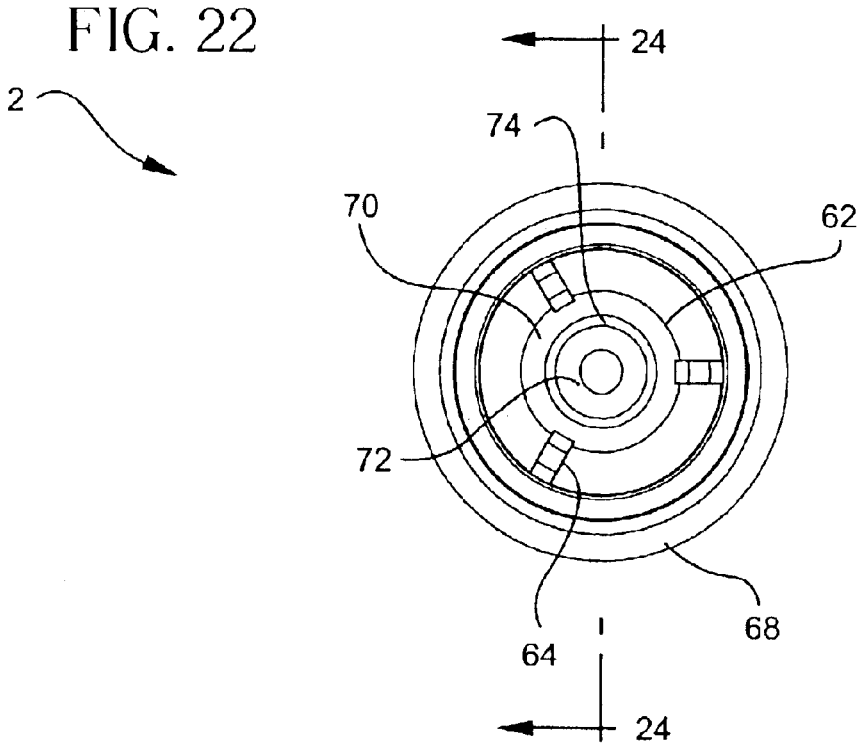
FIG. 22 is a top plan view of the plug structure of the dispenser cap assembly of the present invention.
Figure 23:
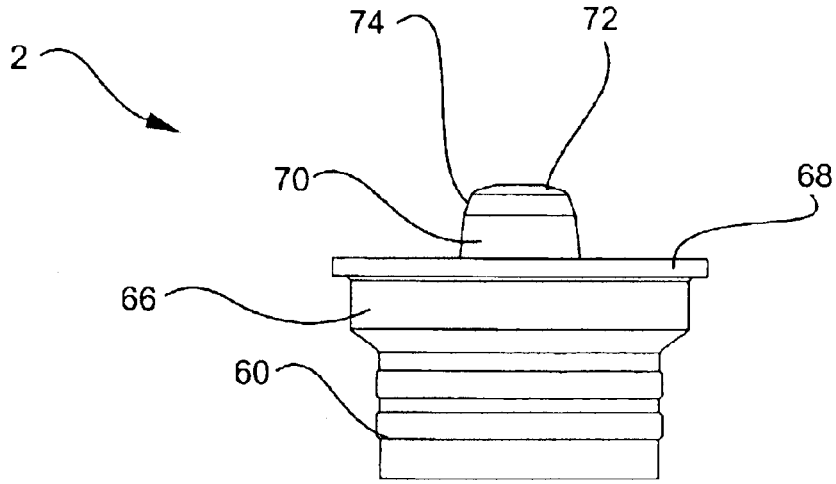
FIG. 23 is a side view of the plug structure of the dispenser cap assembly of the present invention.
Figure 24:
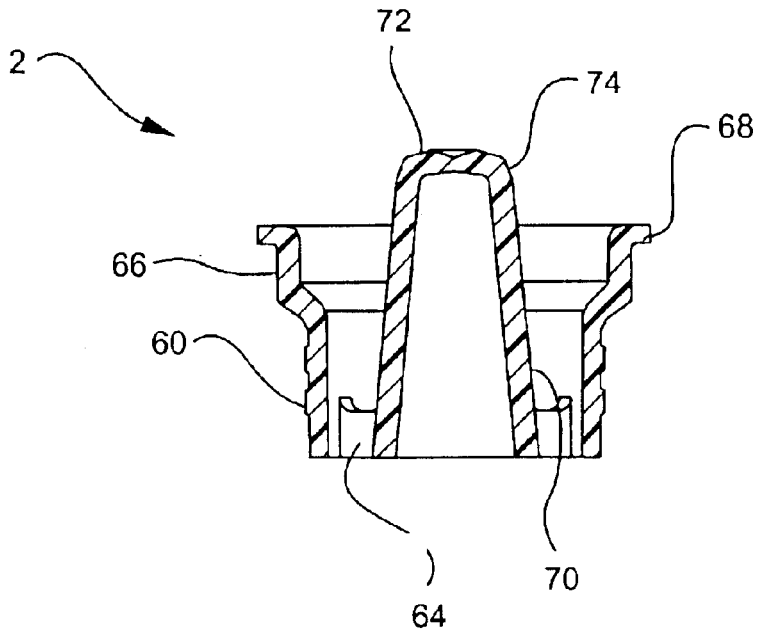
FIG. 24 is a cross sectional view of the plug structure of the dispenser cap assembly of the present invention, taken along line 24—24 of FIG. 22.
Figure 25:
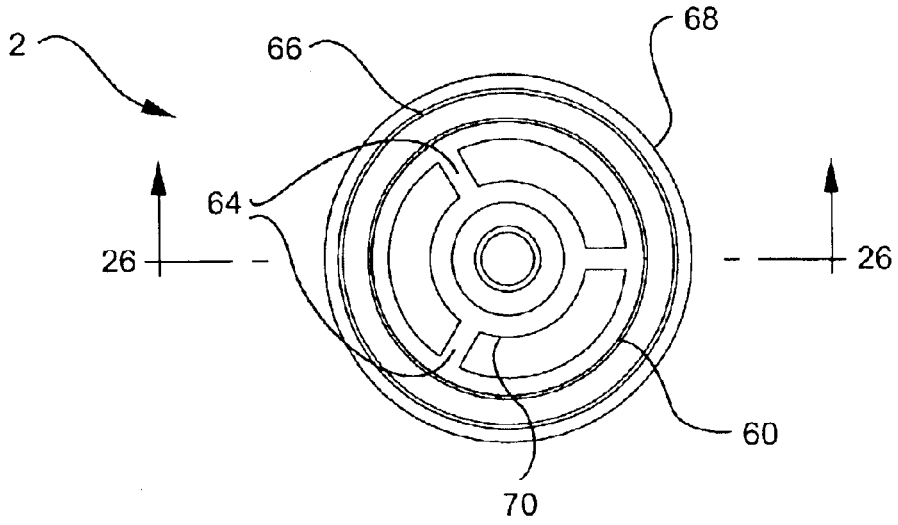
FIG. 25 is a bottom plan view of the plug structure of the dispenser cap assembly of the present invention.
Figure 26:
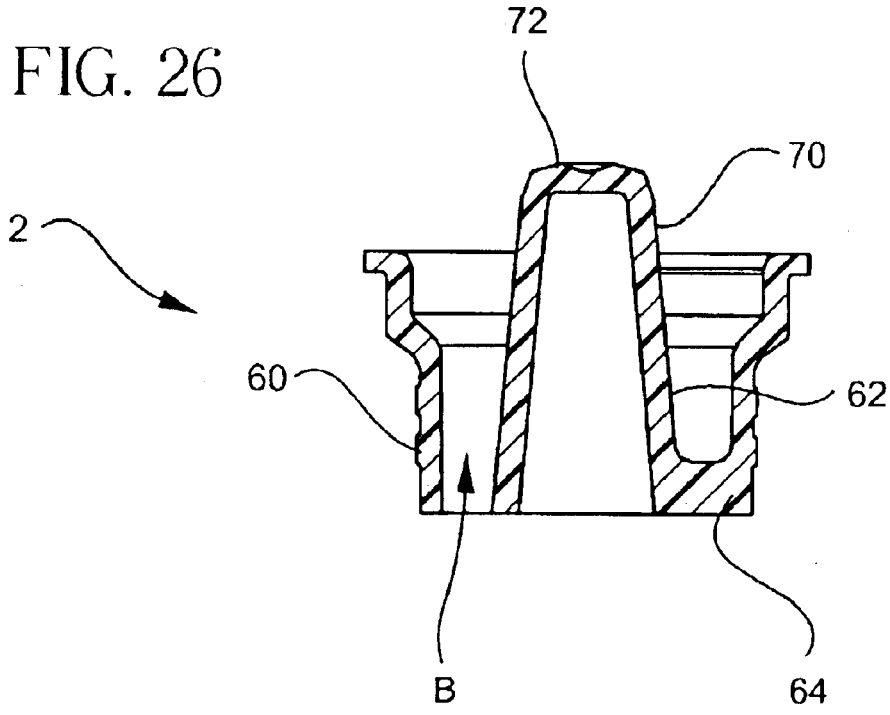
FIG. 26 is a cross sectional view of the plug structure of the dispenser cap assembly of the present invention, taken along line 26—26 of FIG. 25.
Figure 27:
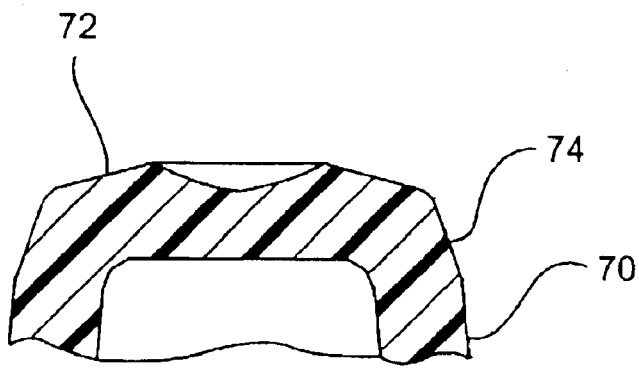
FIG. 27 is an enlarged, detailed view of a portion of the plug structure of the dispenser cap assembly of the present invention.
Figure 28:
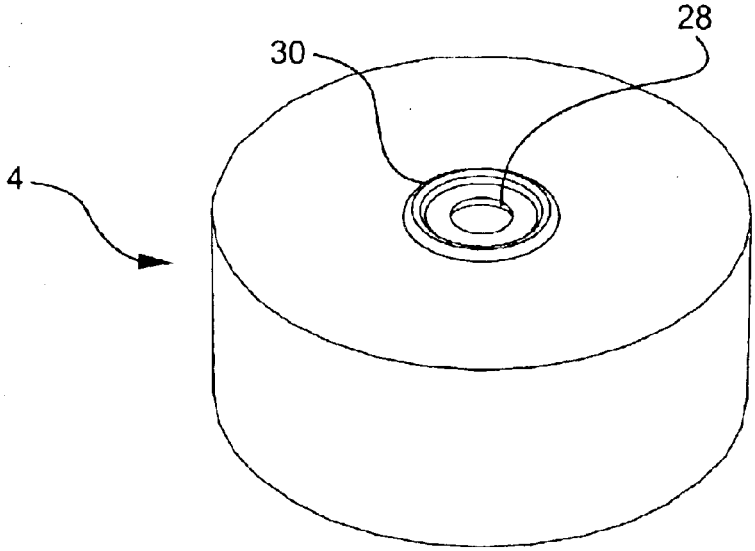
FIG. 28 is top isometric view of the cap subassembly of the dispenser cap assembly formed in accordance with the present invention.
Figure 29:
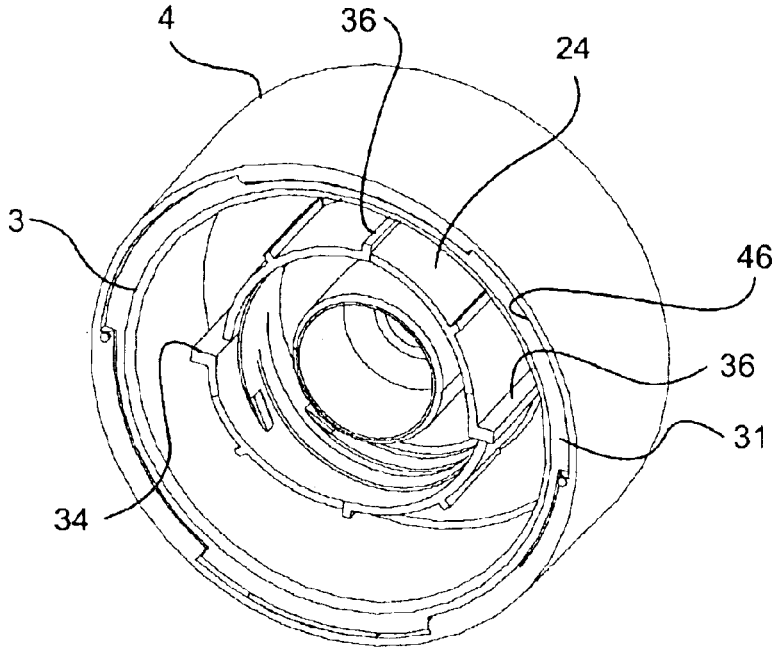
FIG. 29 is a bottom isometric view of the cap subassembly of the dispenser cap assembly formed in accordance with the present invention.
Figure 30:
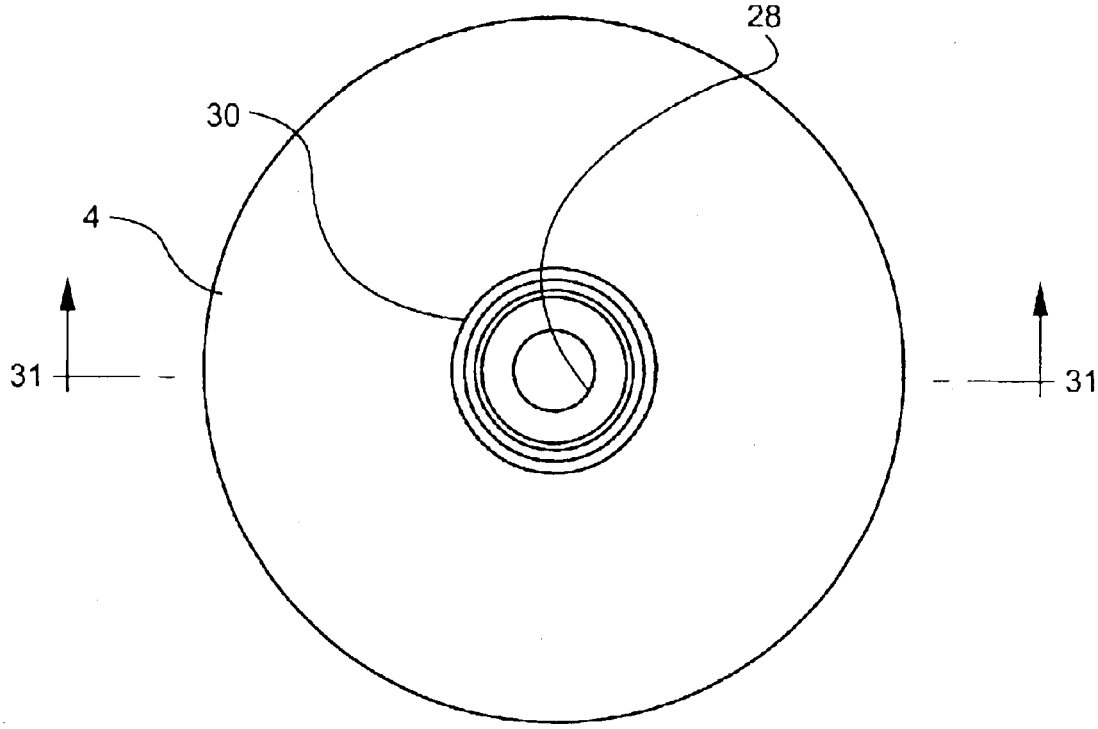
FIG. 30 is a top plan view of the cap subassembly of the dispenser cap assembly of the present invention.
Figure 31:
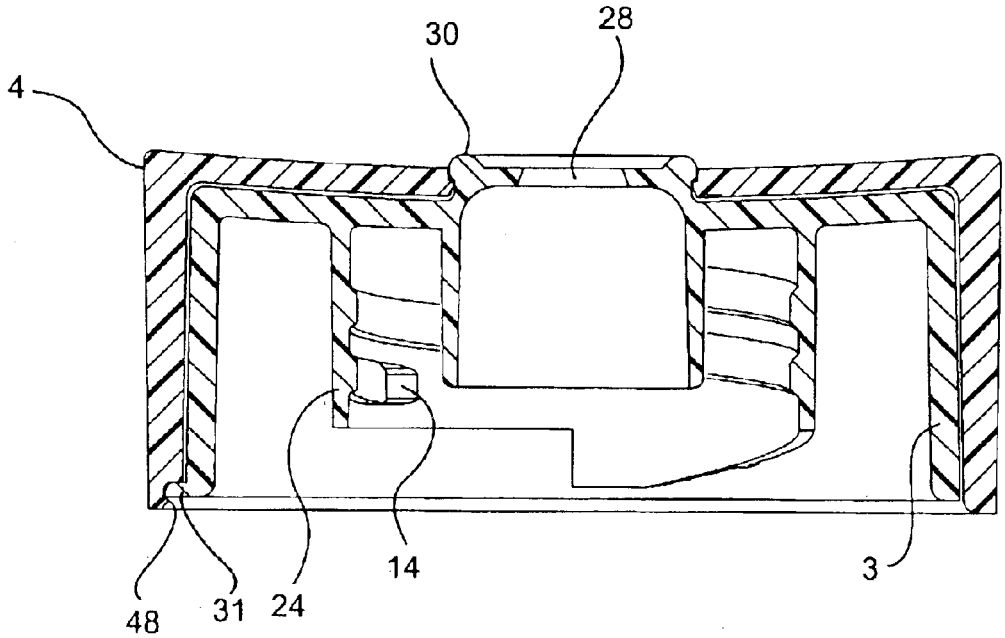
FIG. 31 is a cross sectional view of the cap subassembly of the dispenser cap assembly taken along line 31—31 of FIG. 30.
Figure 32:
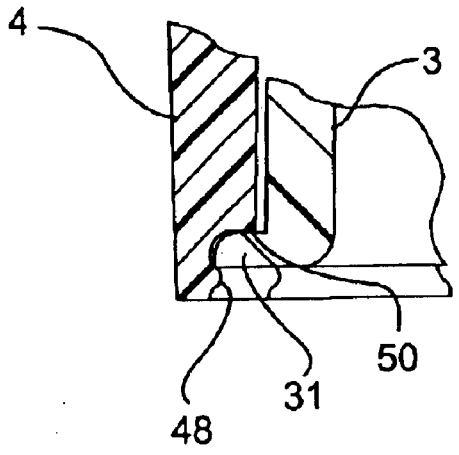
FIG. 32 is an enlarged, detailed view of a portion of the cap subassembly of the dispenser cap assembly of the present invention.
Figure 33:
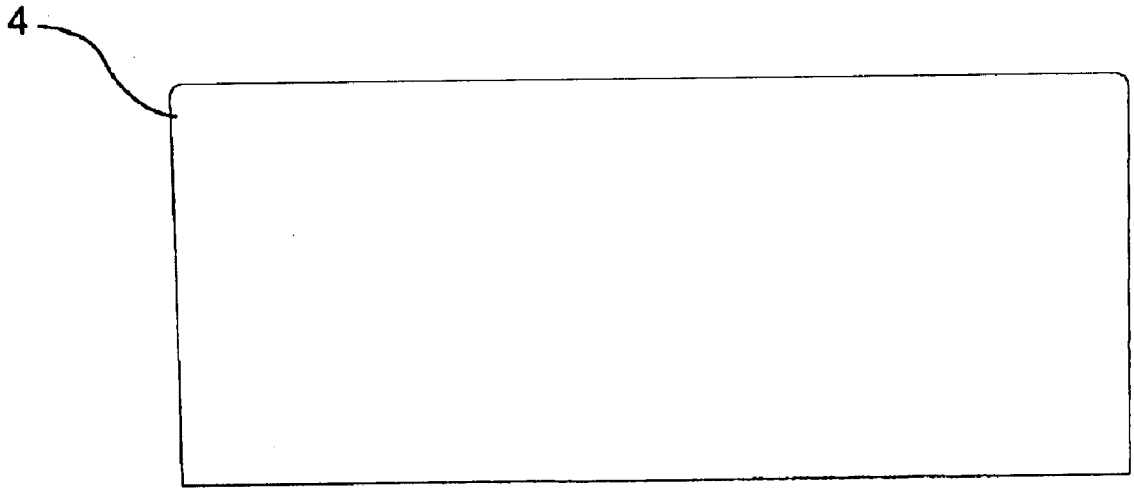
FIG. 33 is a side view of the cap subassembly of the dispenser cap assembly of the present invention.
Figure 34:
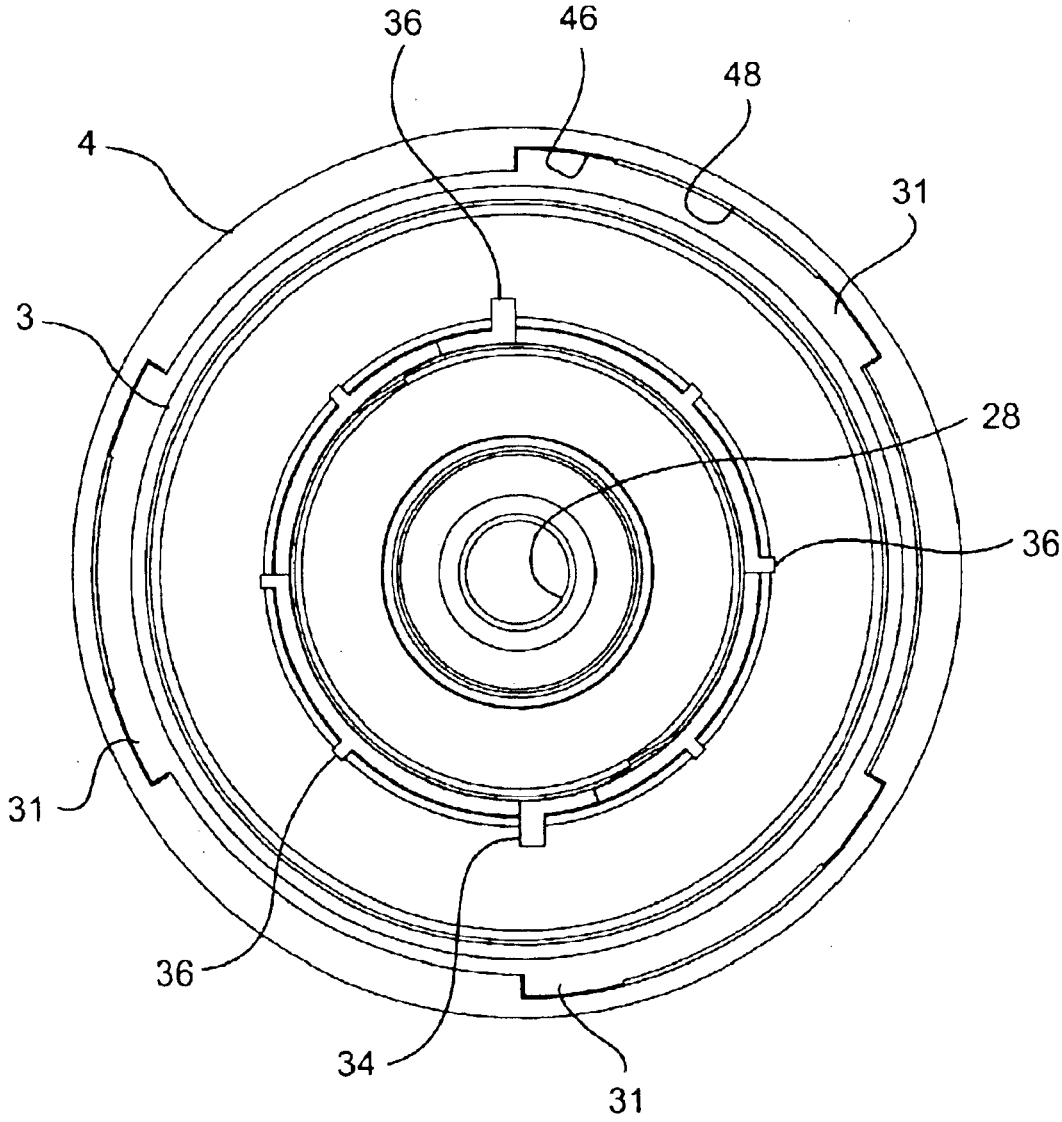
FIG. 34 is a bottom plan view of the cap subassembly of the dispenser cap assembly of the present invention.

FIGS. 1 and 2 show in exploded views the dispenser cap assembly formed in accordance with one form of the present invention. The dispenser, cap assembly is fitted onto preferably a blow molded plastic container, bottle or tube (shown partially as reference numeral 1). The cap assembly has a inner sleeve 3 which is received by and secured inside an outer shell 4. The outer shell 4 is preferably clear but may be translucent or at least partially transparent over all or a portion thereof, and the inner sleeve 3 may be made of a variety of colors to match the color of the blow molded container 1 on which it is fitted, or may be of any color desirable by the manufacturer. In other words, the inner sleeve 3 is viewable through all or a portion of the outer shell 4. The cap assembly also includes a plug structure 2 which is fitted onto the threaded neck 13 of the container 1.

The preferred structure of the inner sleeve 3 is shown in FIGS. 3–12, which include various views and details of the inner sleeve. It basically includes a top wall 20 from the bottom surface of which extend perpendicularly thereto three concentric sidewalls—an inner wall 22, a middle wall 24 disposed about the inner wall and an outer wall 26 disposed about the middle wall. As will be described in greater detail, the diameter of the inner wall 22 is dimensioned so as to cooperate with one of the walls of the plug structure 2 to prevent fluid from escaping from the bottle 1 except under certain conditions. The middle wall 24 is dimensioned in diameter to fit over the neck 13 of the container or bottle 1, and has formed on the radially inner surface thereof threads 14 which cooperate with the threads of threaded neck 13 of the bottle 1. The outer wall 26 is dimensioned in diameter so that it is capable of being received closely by the outer shell 4, as will be explained in greater detail. The top wall 20 of the inner sleeve 3 is preferably slightly concave so that it extends slightly inwardly of inner sleeve 3. The top wall 20 further includes a hole 28 formed through the thickness thereof at the center of the top surface and in the center of the area defined by the inner sidewall 22. The hole 28 is dimensioned to cooperate with a tapered plug of the plug structure 2 to help selectively seal and unseal the bottle when the cap subassembly defined by the assembled inner sleeve 3 and outer shell 4 is turned in either direction on the threaded neck 13 of the bottle 1.

Surrounding the opening 28 is an upstanding boss 30 in which opening 28 is formed, which boss has a protruding peripheral rim 32 which, as will be described in greater detail, is received by an opening formed in the outer shell 4.

The inner sleeve 3 also includes at least one but preferably three flanges 31 spaced apart 120 degrees about the peripheral lower edge of outer sidewall 26 and extending radially outwardly from the outer surface of outer sidewall 26 over a portion of the periphery, each flange thereby forming an arc of a predetermined circumferential distance.

The middle sidewall 24 is circumferentially ramped in the axial direction of the inner sleeve 3. More specifically, the middle wall 24 is cut to form two diametrically opposed ramps 33 which extend over about a 90 degree arc about the circumference of the middle wall 24. The end of each ramp 33 thus forms a shoulder 34 with a strengthening rib 36 protruding slightly radially from the outer surface of middle wall 24 and axially along the diametrically opposed shoulders 34. The ramps 33 start from the free end of the middle wall 24 opposite each other at point A shown in FIG. 7 and extend in a ramping fashion to extend the overall length of middle wall 24 until it reaches a flat surface 37, which acts as the farthest projection of middle wall 24 before it terminates in shoulder 34 and rib 36.

The outer shell 4 is shown in the several views of FIGS. 13–19. It is preferably clear (the inner sleeve 3 is preferably colored so that it shows through clear shell 4). The outer shell 4 includes a top wall 40 which may be substantially flat but preferably is slightly concave so that it extends slightly inwardly of outer shell 4, and an outer wall 42 which extends perpendicularly from the peripheral edge of top wall 40. The top wall 40 also has an opening 44 formed centrally through the thickness thereof.

Preferably at least one, but more preferably three, partial cutouts 46 are formed in the inner surface of sidewall 42 of outer shell 4 over a portion of the circumference of the outer wall 42 and spaced apart 120 degrees from each other. These partial cutouts 46 define an arc which has a circumferential length that is equal to or slightly larger than the length of flanges 31 formed on the inner sleeve 3 so that the flanges 31 may be received by the partial cutouts 46. A rib 48 extends radially inwardly from each partial cutout 46, and is spaced apart from a bottom shoulder at least partially defining cutout 46 so as to capture between the shoulder 50 and the rib 48 the flanges 31 of the inner sleeve 3 when the inner sleeve 3 is received by outer shell 4. Thus, inwardly protruding rib 48 and shoulder 50 of each partial cutout 46 capture the flange 31 between them and secure the inner sleeve 3 inside outer shell 4 when inner sleeve 3 is press fitted into outer shell 4.

Opening 44 formed in the top wall 40 of outer shell 4 is dimensioned in diameter to closely receive boss 30 which is preferably also held in place through the interaction of rim 32 with the inner edge of top wall 40 defining the opening 44.

The concavity of the top wall 40 of the outer shell 4 is provided to allow the bottle 1 with the cap subassembly affixed thereto to rest upside down on the cap subassembly without tipping over. In other words, the concavity recesses the boss 30 of the inner sleeve 3, which extends partially through opening 40 in the outer shell 4 when the inner sleeve 3 is assembled with shell 4, below the level of the outer peripheral edge of outer shell 4 so that the boss 30 does not interfere with the stability of the bottle and cap subassembly when the bottle rests upside down on a surface. The concavity in the top wall 20 of the inner sleeve 3 closely matches that of the top wall 40 of the outer shell 4.

The plug structure 2 is shown in FIGS. 20–27 in various views. As shown in the exploded views in FIGS. 1 and 2, the plug structure is fitted into the opening 6 of threaded neck 13 of container 1. The plug structure includes an outer sidewall 60 and an inner closed plug 62 which is supported in at least one, but more preferably three, places by one or more ribs 64 extending inwardly from outer wall 60 to plug 62, each rib being spaced apart 120 degrees and positioned at the lower edge of plug 62 and outer wall 60. The lower portion of plug structure 2 thus has three open areas, each area being circumferentially situated between adjacent pairs of the three ribs 64 and defined between the inner surface of outer sidewall 60 and the outer surface of plug 62 to allow the contents of bottle 1 to flow therebetween in the direction B shown in the cross-section view of the plug in FIG. 26.

The outer wall 60 of plug structure 2 includes a widened mouth portion 66 near its upper portion and has a radially extending shoulder 68. The radially enlarged upper mouth portion 66 is provided so that plug structure 2 may be closely received and retained by, and press fitted into, the opening of threaded neck 13 of container 1, with shoulder 68 resting on the exposed upper edge of threaded neck 13. Another advantage of having a plug structure 2 with this particular outer shape is that the smaller diameter lower portion defined by outer wall 60 helps in self-centering the plug structure in the bottle opening 6, thus facilitating an automated machine to locate the bottle opening and drop the plug structure in place in the opening, and then apply pressure to seat the enlarged upper mouth portion 66 in the bottle opening 6, with shoulder 68 abutting the edge of the bottle neck defining the opening.

The plug 62 has basically a truncated conical shape with an inwardly tapered circumferential sidewall 70 which converges into a closed plug top 72. The particular diameter and angle of the wall 70 of plug 62 and size of plug top 72 are such that it is closely received by opening 28 formed on inner sleeve 3. It should be noted that opening 28 may also have a slight taper to it to conform to the taper of sidewall 70 of plug 62. Also, it should be noted that plug 62 includes a beveled edge 74 where sidewall 70 meets plug top 72. This beveled edge 74 will allow more of the contents of bottle 1 to flow between sidewall 70 of plug 62 and opening 28 of inner sleeve 3, depending on whether the cap subassembly is in a loosened position on bottle 1, or in a tightened position.

As shown in FIGS. 1 and 2, plug structure 2 is fitted onto, and secured in, the opening in the threaded neck 13 of bottle 1. Inner sleeve 3 is snap fitted into outer shell 4 by first aligning the flanges 31 formed on inner sleeve 3 with the partial cutouts 46 formed in outer shell 4. The inner sleeve 3 is then retained within outer shell 4 and define a unitary cap subassembly. The cap subassembly is then threaded onto bottle neck 13, with the threads on the bottle cooperating with the inner threads formed on the middle wall 24 of inner sleeve 3. The plug 62 of plug structure 2 extends through the opening 28 of the inner sleeve 3 and selectively seals in the contents of bottle 1. The cap subassembly which comprises inner sleeve 3 and outer shell 4 is shown in FIGS. 28–34, which include several views of the cap subassembly.

The overall dimensions of the outer shell 4 and the inner sleeve 3 are such so as to allow the inner sleeve to be closely received by the outer shell and also to allow about a $^{15}/_{1000}{}^{th}$ of an inch space between the outer surface of the inner sleeve 3 and the inner surface of the outer shell 4. This spacing is to avoid the occurrence of a phenomenon referred to as "wetting". When a clear plastic material, such as what preferably forms the outer shell 4, contacts a plastic material having a darker colored surface, such as what preferably forms the inner sleeve 3, a visual defect occurs over the area where the two surfaces touch, that is, the colored surface will appear darker. To prevent this, the inner sleeve 3 is "suspended" in the outer shell 4 so that the facing surfaces of their respective top walls and outer sidewalls are spaced apart slightly from each other.

Returning again to FIGS. 1 and 2, the threaded neck 13 of bottle 1 preferably includes two diametrically opposed, radially extending ramps 5 which terminate and thus define radial edges 90 which act as stops and cooperate with shoulders 34 of inner sleeve 3.

When the cap subassembly is fully screwed onto the threaded neck of bottle 1, the plug 62 extends through opening 28 of inner sleeve 3 and seals the opening so that the contents of bottle 1 may not flow therethrough. To allow the contents of the bottle to be dispensed, the cap subassembly (inner sleeve 3 and outer shell 4) are turned in a loosening direction (preferably counter-clockwise, looking down on the top of the cap subassembly) one-quarter turn until each shoulder 34 on inner sleeve 3 abuts against a cooperating edge stop 90 formed on bottle neck 13. By loosening the cap subassembly one-quarter turn, the cap assembly rises on threaded neck 13 in a axially direction with respect to bottle 1, which causes the plug 62 and boss 30 of inner sleeve 3 to separate and allow space between plug 62 and the inner edge wall defining the opening 28, which allows the contents of the bottle to flow through opening 28. In other words, by unscrewing the cap subassembly slightly (one-quarter turn), the cap subassembly rises on threaded neck 13, and now plug 72 is no longer closely received by opening 28. One-quarter turn in the tightening direction (preferably the clockwise direction, looking down on the top of the cap subassembly) will lower the cap assembly onto plug 62, closing opening 28.

Figure 35:
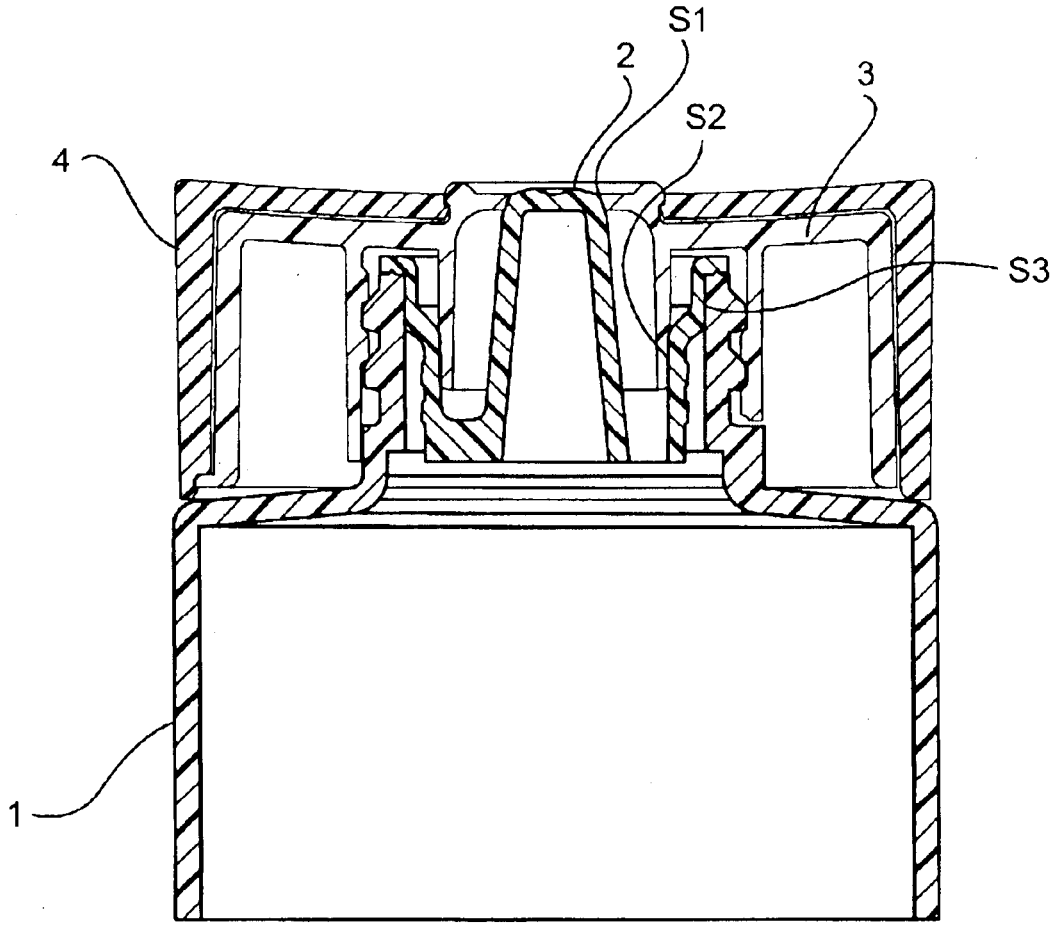
FIG. 35 is a cross sectional view of the dispenser cap assembly formed in accordance with the present invention, shown mounted on a container and illustrating the leakproof seals provided by the dispenser cap assembly when it fully engages the container on which it is mounted.

With the structure of the present invention, there are three primary sealing areas that prevent the contents of bottle 1 from being inadvertently dispensed. This is shown in FIG. 35, which is a cross-sectional view of the cap assembly fitted onto bottle 1. The first sealing area, designated by alphanumeric reference S1, is where the plug 62 engages the inner edge wall defining opening 28 in boss 30 of inner shell 3. This seal controls the flow of product from the container 1. The second seal (which is designated by alphanumeric reference S2 in FIG. 35) is a rotating frictional seal between the inner surface of outer wall 60 of plug structure 2 and the outer surface of inner sidewall 22 of inner sleeve 3. This seal prevents the product in the container from leaking to the outside environment. The third seal (designated by alphanumeric reference S3 in FIG. 35) is a friction, annual seal between the outer surface of the enlarged mouth portion 66 of outer sidewall 60 of the plug structure 2 and the inner surface of the threaded neck 13 of the container 1 which defines the container opening. This seal also prevents the product in the container from leaking to the outside environment.

As may be seen from the foregoing description, the dispenser cap of the present invention has many desirable features. For example, the colored inner sleeve and the clear outer shell allow the manufacturer to easily select the color of the cap by merely choosing a desired colored inner sleeve to be received by the clear outer shell.

The dispenser cap of the present invention also provides sufficient stability to the container on which it is mounted to allow the container to rest vertically, upside down on the cap. For flowable container contents having a high viscosity, this is especially useful, as the contents will have settled by gravity toward the cap and be immediately available to the user for dispensing. Also, the dispenser cap of the present invention provides such stability for upside down support for the container, even thought the cap dispenses the container contents through its center. In other words, the particular cooperating structure of the outer shell, inner sleeve and plug provides for the dispensing of the container contents through the center of the cap without interfering with the ability of the cap to support the container on which it is mounted vertically, upside down, when not in use.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A dispenser cap assembly for mounting on a container having a threaded neck and an opening formed in the threaded neck, the dispenser cap assembly comprising:

an outer shell;

an inner sleeve received by the outer shell; and a plug structure received by the opening of the container and the inner sleeve and cooperating with the inner sleeve to selectively allow egress of the contents of the container through the inner sleeve and outer shell, wherein the plug structure includes an outer sidewall having an upper portion and a lower portion, an elongated inner closed plug disposed radially inwardly of the outer sidewall and having a lower edge, and at least one rib extending radially between the outer sidewall of the plug structure at the lower portion of the outer sidewall and the elongated inner closed plug at the lower edge thereof to support the elongated inner closed plug in a spaced apart relationship to the outer sidewall, the outer sidewall of the plug structure and the elongated inner closed plug defining therebetween an open area to allow egress of the contents of the container to pass therethrough, the elongated inner closed plug being selectively in contact with a portion of the top wall of the inner sleeve defining the opening therein to selectively allow egress of the contents of the container to pass through the opening in the top wall of the inner sleeve.

2. A dispenser cap assembly as defined by claim 1, wherein the elongated inner closed plug has a truncated conical shape.

3. A dispenser cap assembly as defined by claim 1, wherein the inner closed plug has a truncated conical shape and includes an elongated sidewall, a top portion and a beveled edge interposed between the elongated sidewall of the plug and the top portion of the plug.

4. A dispenser cap assembly as defined by claim 1, wherein the plug structure is dimensioned to be closely received by the opening of the threaded neck of the container such that the outer sidewall of the plug structure engages a portion of the container defining the container opening to form a first seal therewith; wherein the inner wall of the inner sleeve engages the outer sidewall of the plug structure to form a second seal therewith; and wherein the elongated inner closed plug of the plug structure selectively engages the top wall portion of the inner sleeve defining the opening in the top wall to selectively form a third seal therewith.

5. A dispenser cap assembly as defined by claim 1, wherein the outer shell is at least partially transparent so that the inner sleeve is viewable therethrough.

6. A dispenser cap assembly as defined by claim 1, wherein the outer shell has a top wall which is one of substantially flat and slightly concave to allow the top wall to rest on a flat surface and support the container in a vertically upside down position when the cap assembly is mounted on the container.

7. A dispenser cap assembly as defined by claim 1, wherein the outer sidewall of the plug structure includes an enlarged diameter mouth portion near the upper portion thereof, a relatively smaller diameter lower portion, and a radially extending shoulder near the upper portion of the outer sidewall, the radially extending shoulder being restable on the threaded neck of the container, the enlarged diameter mouth portion and the relatively smaller diameter lower portion facilitating the self-centering of the plug structure in the opening of container.

8. A dispenser cap assembly for mounting on a container having an opening formed therein, the dispenser cap assembly comprising:

an outer shell;

an inner sleeve received by the outer shell; and a plug structure received by the opening of the container and the inner sleeve and cooperating with the inner sleeve to selectively allow egress of the contents of the container through the inner sleeve and outer shell, wherein the inner sleeve includes a top wall, an inner wall, a middle wall disposed concentrically about the inner wall and an outer wall disposed concentrically about the middle wall, the inner wall, middle wall and outer wall extending perpendicularly in the same direction from the top wall of the inner sleeve, the top wall of the inner sleeve having an opening formed through the thickness thereof which selectively receives at least a portion of the plug structure.

9. A dispenser cap assembly as defined by claim 8, wherein the outer shell is at least partially transparent so that the inner sleeve is viewable therethrough.

10. A dispenser cap assembly as defined by claim 8, wherein the outer shell has a top wall which is one of substantially flat and slightly concave to allow the top wall to rest on a flat surface and support the container in a vertically upside down position when the cap assembly is mounted on the container.

11. A dispenser cap assembly as defined by claim 8, wherein at least a portion of the middle wall of the inner sleeve includes threads which cooperate with threads formed on the container, and wherein the outer wall of the inner sleeve is dimensioned to be closely received by the outer shell.

12. A dispenser cap assembly as defined by claim 8, wherein each of the top walls of the inner sleeve and outer shell is slightly concave and includes an opening formed through the thickness thereof, and wherein the top wall of the inner sleeve includes an upstanding boss surrounding the opening formed therein, the boss having a protruding peripheral rim which is received by the opening formed in the top wall of the outer sleeve.

13. A dispenser cap assembly as defined by claim 8, wherein the inner sleeve includes at least one flange formed on a peripheral lower edge of the outer wall of the inner sleeve and extending radially outwardly therefrom over at least a portion of a periphery thereof, and wherein the outer shell includes an outer wall extending perpendicularly from the top wall of the outer shell, the outer wall having at least one cutout formed therein over at least a portion of the circumference thereof and receiving the at least one flange of the inner sleeve, the inner sleeve being closely received by the outer shell and being suspended therein so that the respective outer walls and top walls of the outer shell and inner sleeve are spaced apart slightly from each other to avoid a wetting phenomenon.

14. A dispenser cap assembly as defined by claim 13, wherein the outer shell is formed with at least one radially inwardly extending rib disposed in proximity to the at least one cutout, and a shoulder spaced apart from the at least one rib and at least partially defining the at least one cutout to capture therebetween the at least one flange of the inner sleeve to help secure the inner sleeve to the outer shell.

15. A dispenser cap assembly as defined by claim 8, wherein the plug structure includes an outer sidewall, an inner closed plug disposed radially inwardly of the outer sidewall, and at least one rib extending between the outer sidewall of the plug structure and the inner closed plug to support the inner closed plug in a spaced apart relationship to the outer sidewall, the outer sidewall of the plug structure and the inner closed plug defining therebetween an open area to allow egress of the contents of the container to pass therethrough, the inner closed plug being selectively in contact with a portion of the top wall of the inner sleeve defining the opening therein to selectively allow egress of the contents of the container to pass through the opening in the top wall of the inner sleeve.

16. A dispenser cap assembly as defined by claim 15, wherein the inner closed plug has a truncated conical shape.

17. A dispenser cap assembly as defined by claim 15, wherein the inner closed plug has a truncated conical shape and includes a sidewall, a top portion and a beveled edge interposed between the sidewall of the plug and the top portion of the plug.

18. A dispenser cap assembly as defined by claim 15, wherein the plug structure is dimensioned to be closely received by the opening of the container such that the outer sidewall of the plug structure engages a portion of the container defining the container opening to form a first seal therewith; wherein the inner wall of the inner sleeve engages the outer sidewall of the plug structure to form a second seal therewith; and wherein the inner closed plug of the plug structure selectively engages the top wall portion of the inner sleeve defining the opening in the top wall to selectively form a third seal therewith.

* * * * *